US011730208B2

(12) United States Patent
Holland

(10) Patent No.: US 11,730,208 B2
(45) Date of Patent: Aug. 22, 2023

(54) UPPER TORSO BODY GARMENT WITH ADJUSTABLE BRIDGE SYSTEM

(71) Applicant: Jennifer Bobbin Holland, Ny, NY (US)

(72) Inventor: Jennifer Bobbin Holland, Ny, NY (US)

( * ) Notice: Subject to any disclaimer, the term of this patent is extended or adjusted under 35 U.S.C. 154(b) by 57 days.

(21) Appl. No.: 17/541,189

(22) Filed: Dec. 2, 2021

(65) Prior Publication Data

US 2023/0172286 A1 Jun. 8, 2023

(51) Int. Cl.
*A41C 3/00* (2006.01)
*A41C 3/12* (2006.01)

(52) U.S. Cl.
CPC ..... *A41C 3/0028* (2013.01); *A41C 3/128* (2013.01)

(58) Field of Classification Search
CPC ..... A41C 3/0028; A41C 3/128
USPC ..... 450/58
See application file for complete search history.

(56) References Cited

U.S. PATENT DOCUMENTS 1,871,106 A 8/1932 Yerkes
2,406,699 A 8/1946 Florence
2,542,881 A 2/1951 Ries
2,683,879 A * 7/1954 Dollarhide ..... A41C 3/0028 D2/709
2,970,597 A * 2/1961 Michel ..... A41C 3/02 450/71
3,077,885 A 2/1963 Hopper
3,378,013 A * 4/1968 Bruno ..... A41C 3/00 D2/708
3,465,754 A 9/1969 Lockwood et al.
4,411,269 A 10/1983 Weintraub
5,964,642 A 10/1999 Fildan
6,155,906 A 12/2000 May
6,280,287 B1 * 8/2001 Keith ..... A41F 1/006 450/41
6,406,354 B1 6/2002 Yamauchi et al.
6,547,636 B1 4/2003 Cato
7,056,186 B1 * 6/2006 Weyenberg ..... A41C 3/02 450/65
7,232,359 B1 6/2007 Richardson
7,407,430 B1 8/2008 Wanzenböck et al.
7,833,083 B2 11/2010 Sobah-Wilhelm
8,075,369 B2 12/2011 Hendrickson
8,337,275 B2 * 12/2012 Martins-Crawbuck ..... A41C 3/0028 450/64
8,651,917 B2 2/2014 Lopez et al.
D739,642 S 9/2015 Valencia
9,173,435 B2 11/2015 Bailey et al.
9,596,890 B2 3/2017 Redenius
9,961,944 B2 5/2018 Fayad
(Continued)

FOREIGN PATENT DOCUMENTS

GB 2376171 A 12/2002

*Primary Examiner* — Gloria M Hale
(74) *Attorney, Agent, or Firm* — Howard University School of Law; Darrell G. Mottley

(57) ABSTRACT

A garment adapted for wearing around a torso of a human body. The garment may include a first and second brassiere cups, a first and second side panel wings attached to the outermost edge of the cups to support the peripheral sides of the breast and armpits. An adjustable bridge system containing a mechanism that allows the wearer of a bra, swimsuit, or similar foundation garment to adjust the distance between the cups or breast coverings.

8 Claims, 8 Drawing Sheets

(56) References Cited

U.S. PATENT DOCUMENTS

| | | | | |
|---|---|---|---|---|
| 9,961,966 | B2 | 5/2018 | Ryan | |
| 10,117,468 | B1 | 11/2018 | Clarke | |
| 2003/0003844 | A1 | 1/2003 | Jones et al. | |
| 2006/0079153 | A1 | 4/2006 | Davidson | |
| 2010/0190411 | A1 | 7/2010 | Saraceno et al. | |
| 2011/0081827 | A1 | 4/2011 | Williams | |
| 2011/0275277 | A1* | 11/2011 | Martins-Crawbuck | A41C 3/0028 450/77 |
| 2012/0021669 | A1* | 1/2012 | Johnstone | A41C 3/02 450/86 |
| 2014/0087625 | A1 | 3/2014 | Ironi | |
| 2016/0143372 | A1 | 5/2016 | Anderson | |
| 2020/0113250 | A1* | 4/2020 | Waldman | A41C 3/0092 |

* cited by examiner

UPPER TORSO BODY GARMENT WITH ADJUSTABLE BRIDGE SYSTEM

FIELD

The present disclosure relates to a wearable garment in the form of an adjustable bridge bra for a human body.

BACKGROUND

Conventional brassieres, commonly referred to as bras, have two breast cups, fastened to the upper body of a woman using a band around the torso and shoulder straps. Individuals, in particular women, vary greatly in their chest and breast sizes and also in the amount of physical activity they engage in. Many bras can be uncomfortable to wear or unwearable altogether if not fitted correctly.

SUMMARY

In light of the foregoing background, the following presents a simplified summary of the present disclosure in order to provide a basic understanding of some aspects of said disclosure. This summary is not an extensive overview of the disclosure. It is not intended to identify key or critical elements of the disclosure or to delineate the scope of the disclosure. The following summary merely presents some concepts of the disclosure in a simplified form as to prelude to the more detailed description provided below.

Aspects of the present disclosure include a garment adapted for wearing around a torso of a human body. The garment may include a first and second brassiere cups, an adjustable bridge system, a first and second side panel wings attached to the outermost edge of said cups to support the peripheral sides of the breast and armpits.

In one aspect, an adjustable bridge system may include a first connector facing a center valley between the first brassiere cup and the second brassiere cup. A second connector is attached to a free end of a ribbon that is threaded through the first connector. The ribbon includes multiple incrementally spaced vertical seams forming cartridges along a predetermined length below the second brassiere cup and the second connector is adapted to be adaptively placed in one of the incremental cartridges for controlling a distance of the center valley.

In another aspect, an adjustable bridge system may include a first ribbon attached beneath the first brassiere cup in which the first ribbon has a fixed connector at its proximal end facing a valley of the bra. The second brassiere cup may include a movable ribbon portion threaded through the fixed connector and a fixed ribbon portion with multiple vertical seams forming cartridges adapted for a wearer to receive a movable connector to control a space between the first and second cups. The adjustable bridge bra helps solve at one least issue for bra-wearers who struggle with finding bras with fixed center bridges uncomfortable—particularly those who have a narrower or wider spacing between breasts.

In another aspect, the garment may include a plurality of parallel shoulder straps, wherein the straps are attached to both the first and second brassiere cups at the posterior and the first and second side panel underband "wings" toward the anterior of the garment to allow the wearer to adjust the length of the straps to best adhere to the wearer's upper body dimensions.

In another aspect, the garment may include mesh side panels for supporting the outermost sides of the breasts and underarm area.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of aspects. As used in the specification and in the claims, the singular form of 'a', 'an', and 'the' include plural referents unless the context clearly dictates otherwise.

DETAILED DESCRIPTION

Figure 1:
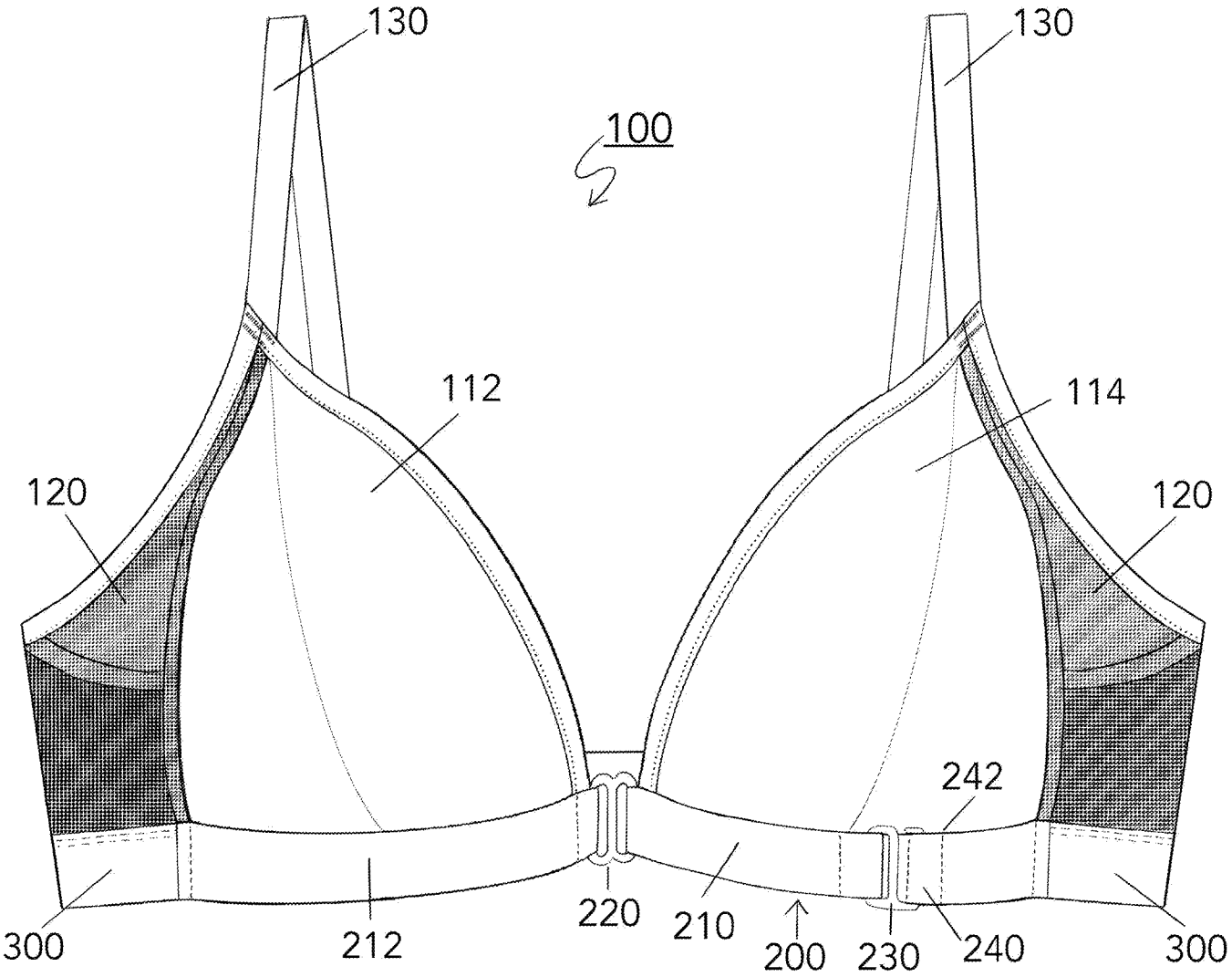
FIG. 1 is a front closed view of the upper torso garment with a rear hook-and-eye closure system fastened and an adjustable bridge system in front configured to laterally move breast cups in which certain aspects of the present disclosure may be implemented.

The accompanying drawings, which form a part hereof, show examples of the disclosure. It is to be understood that the examples shown in the drawings and/or discussed herein are non-exclusive and that there are other examples of how the disclosure may be practiced.

"Configured for wear" can contemplate some amount of adjustment or additional configuration such as opening and/or closing fasteners, and/or some amount of expansion such as one or more elastic regions and/or tight- and loose-fitting regions. Accordingly, the configuration of the wearable device and the manner in which the wearable device is worn by an individual may vary.

FIGS. 1 through 8 illustrate an adjustable brassiere garment (hereinafter "bra") 100 in the form of an upper torso garment designed to support and cover breasts of various sizes and shapes using an adjustable bridge system 200. The bra 100 can be provided in a number of wearable configurations, for example including, a foundation garment, part of a swimsuit, sports bra, or loungewear. The bra 100 construction comprises triangular-shaped cups—a right cup 112 and a left cup 114 directionally when worn on a human body. The cups 112, 114 can be made of a molded foam material to maintain a desired shape. The bra 100 provides the wearer with an option to laterally modify the space between cups 112, 114 to accommodate the distance between the wearer's breasts using the adjustable bridge system 200 in the front portion.

Referring to FIGS. 3-8, the bra 100 has the adjustable bridge system 200 provided below the two molded foam cups 112, 114. In one aspect, the adjustable bridge system 200 construction enables the wearer of a bra, swimsuit, or foundation garment to incrementally adjust the lateral distance between the cups 112, 114 or breast coverings. In another aspect, the adjustable bridge system 200 enables the wearer of the bra 100 to modify the distance between the cups for maximizing a comfortable fit. Most standard bras incorporate a fixed "bridge" or "center gore" to connect the cups at an unchanging distance. This can be inconvenient for someone whose breasts are further apart ("wide set"); closer together ("close set"); or experiencing fluctuations based on temporary conditions like weight gain/loss, hormonal fluctuations, or pregnancy. Under these circumstances, the distance set by the fixed "center gore" or "bridge" can make the garment uncomfortable to wear or unwearable altogether. While conventional bras typically vary in band size (circumference around the body) and cup size (volume of the breasts), they do not accommodate variable breast spacings. Having the ability to vary the distance L between the breast coverings using the adjustable bridge system 200 of the present disclosure also allows the wearer to alter the bra garment 100 so that it may stay hidden below lower-cut and specially-cut tops and dresses. The bra 100 of the present disclosure as designed provides an adaptively movable center bridge in the front thereof to allow the wearer to have opportunities to maximize fit and comfort. Bra 100 can be useful for women nursing infants.

Figure 3:
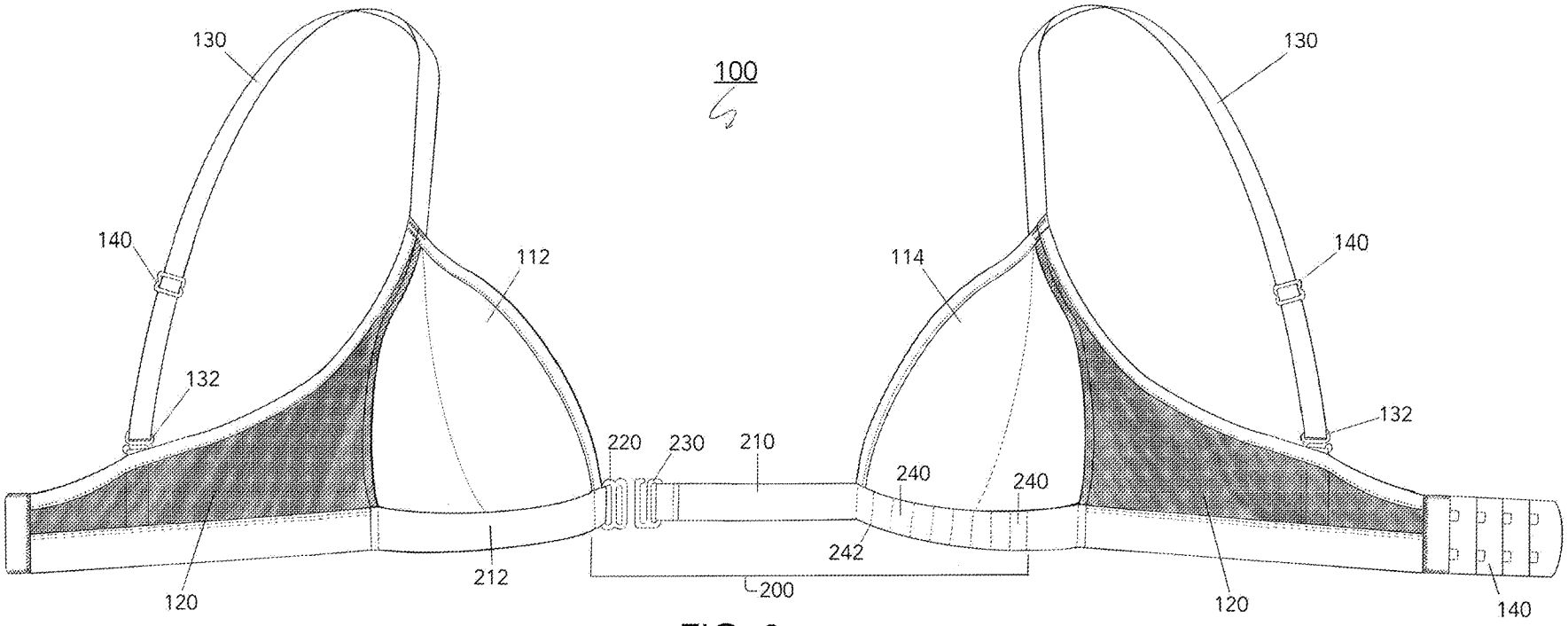
FIG. 3 is a front view of the upper torso garment with the hook-and-eye closure system at the posterior unfastened and the two breast cups are untethered from the adjustable bridge system in which certain aspects of the present disclosure may be implemented.
Figure 4:
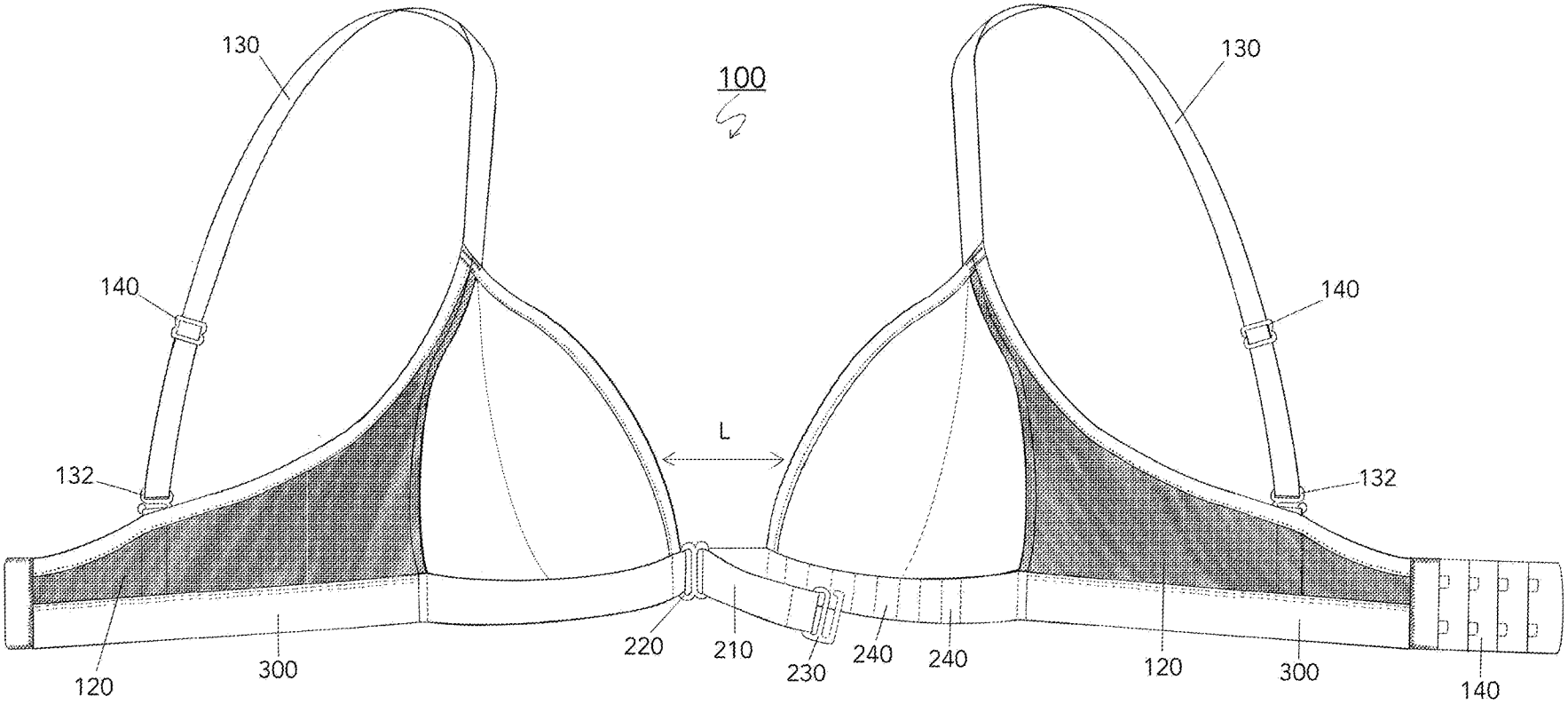
FIG. 4 is the front view of the upper torso garment with the hook-and-eye closure at the posterior unfastened and the two breast cups are tethered by the adjustable bridge system affixed below the molded foam cups, showing a plurality of incremental slots in the bridge system for a connector to matingly attach therein for a more tailored fit in which certain aspects of the present disclosure may be implemented.
Figure 7:
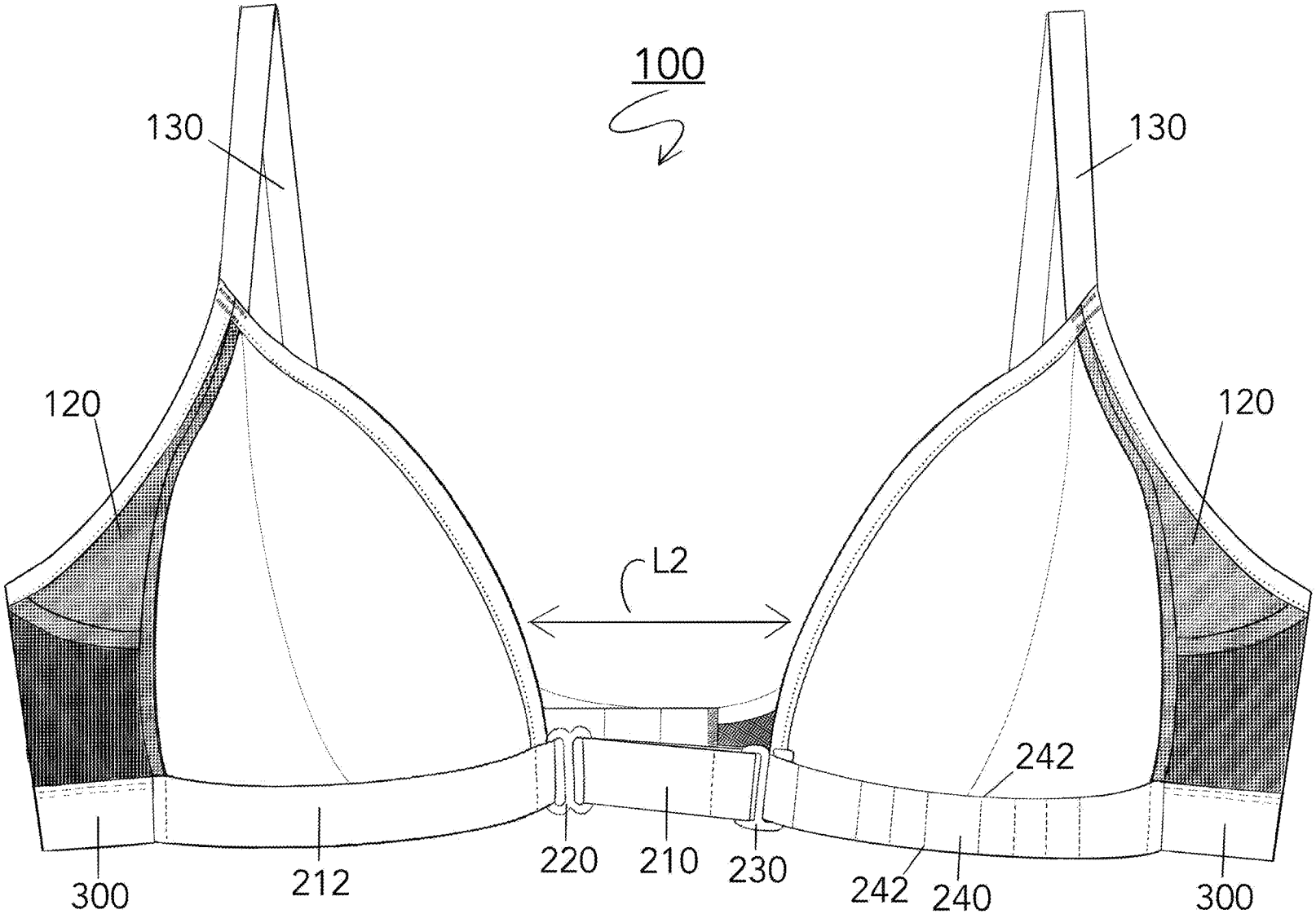
FIG. 7 is a front view of the upper torso garment in which a first alternative adjustable bridge system is provided in a cartridge position in which certain aspects of the present disclosure may be implemented.
Figure 8:
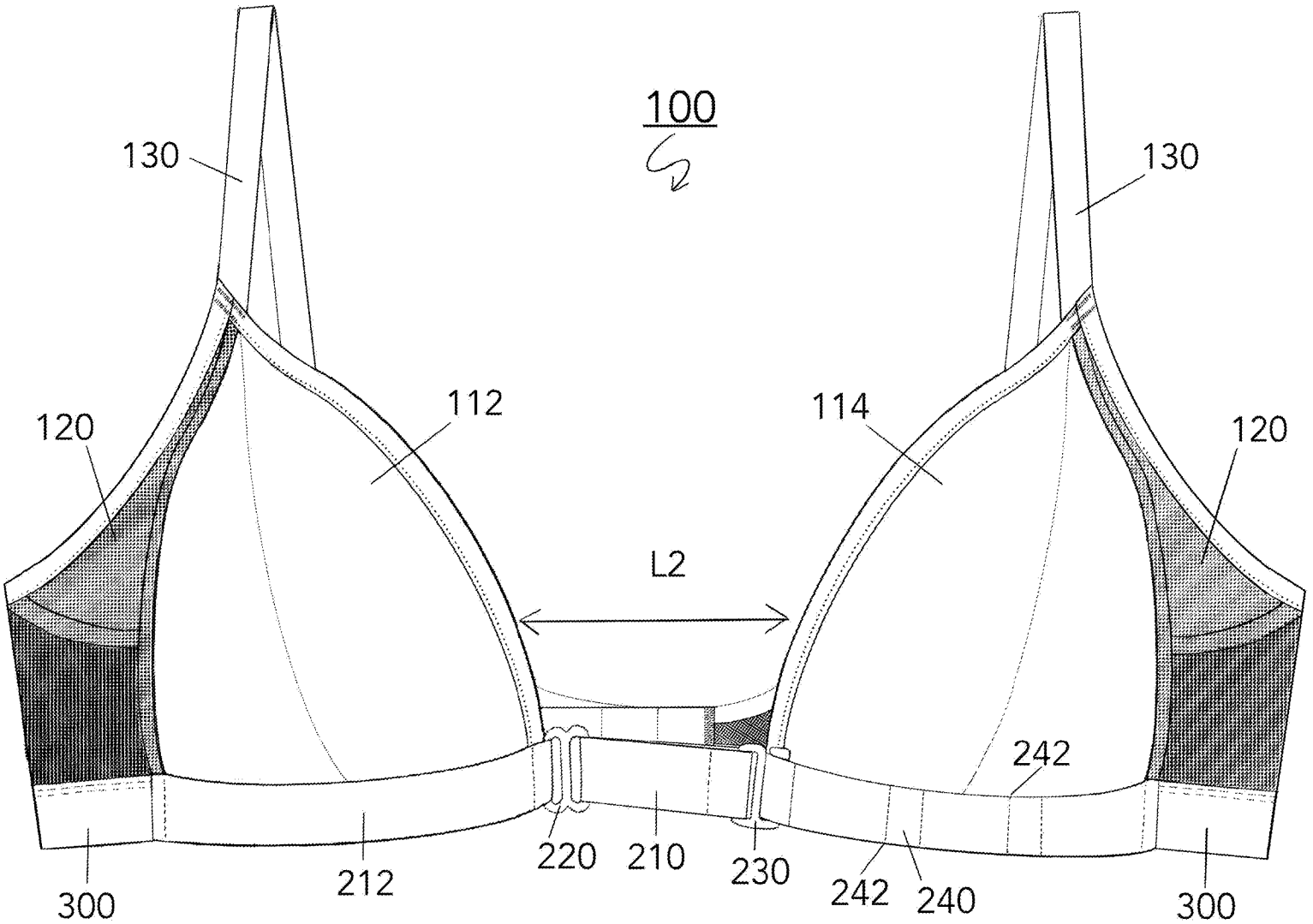
FIG. 8 is a front view of the upper torso garment in which a second adjustable bridge system is provided in a cartridge position in which certain aspects of the present disclosure may be implemented.

Referring to FIG. 4, the adjustable bridge system 200 includes a ribbon 210 that is threaded through a fixed slide 220. The slide 220 is attached to the proximal end at the bottom of the right cup 112. The free end of ribbon 210 includes a freely movable connector 230 in the form of a G-hook construction. As shown in FIG. 3, the adjustable bridge system 200 includes incrementally spaced slots 240 or cartridges along a predetermined length at the bottom/base of the left cup 114. The cartridges 240 are tubular in construction to accommodate receiving a hook end of the movable connector 230 therein. The number of cartridges 240 can be provided depending on the cup size of left cup 114 and right cup 112. In some constructions, the number of evenly spaced incremental cartridges could be 8 to 9. In one construction, the ribbon 210 can be woven and made of a non-elastic material. As depicted in FIGS. 7 and 8, the cartridges 240 can vary in number and spacing, where the width of the cartridges may be at least ¼" but typically less than ½" to keep the connector 230 snuggly secure.

Figure 5:
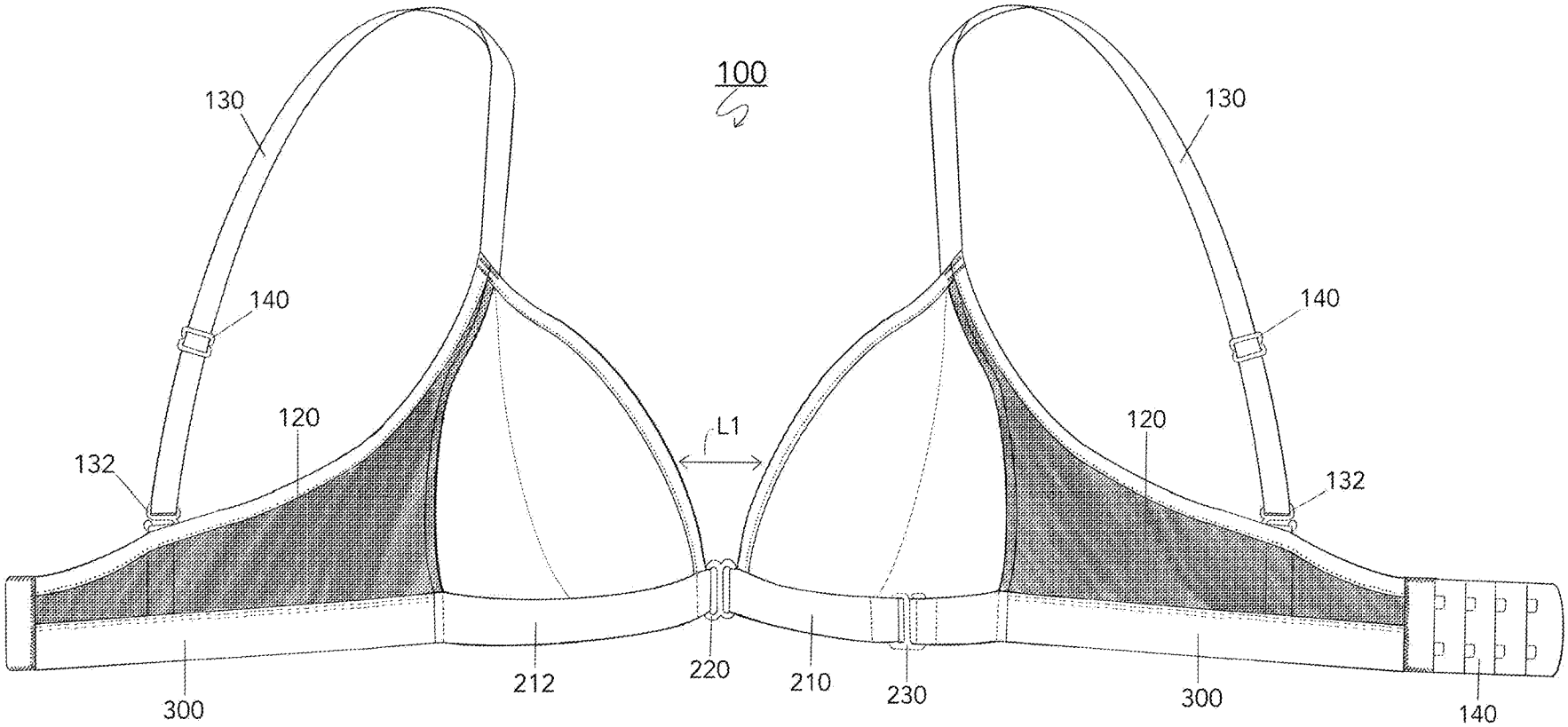
FIG. 5 is a front view of the upper torso garment in which the adjustable bridge system is provided in an incremental cartridge position in which certain aspects of the present disclosure may be implemented.
Figure 6:
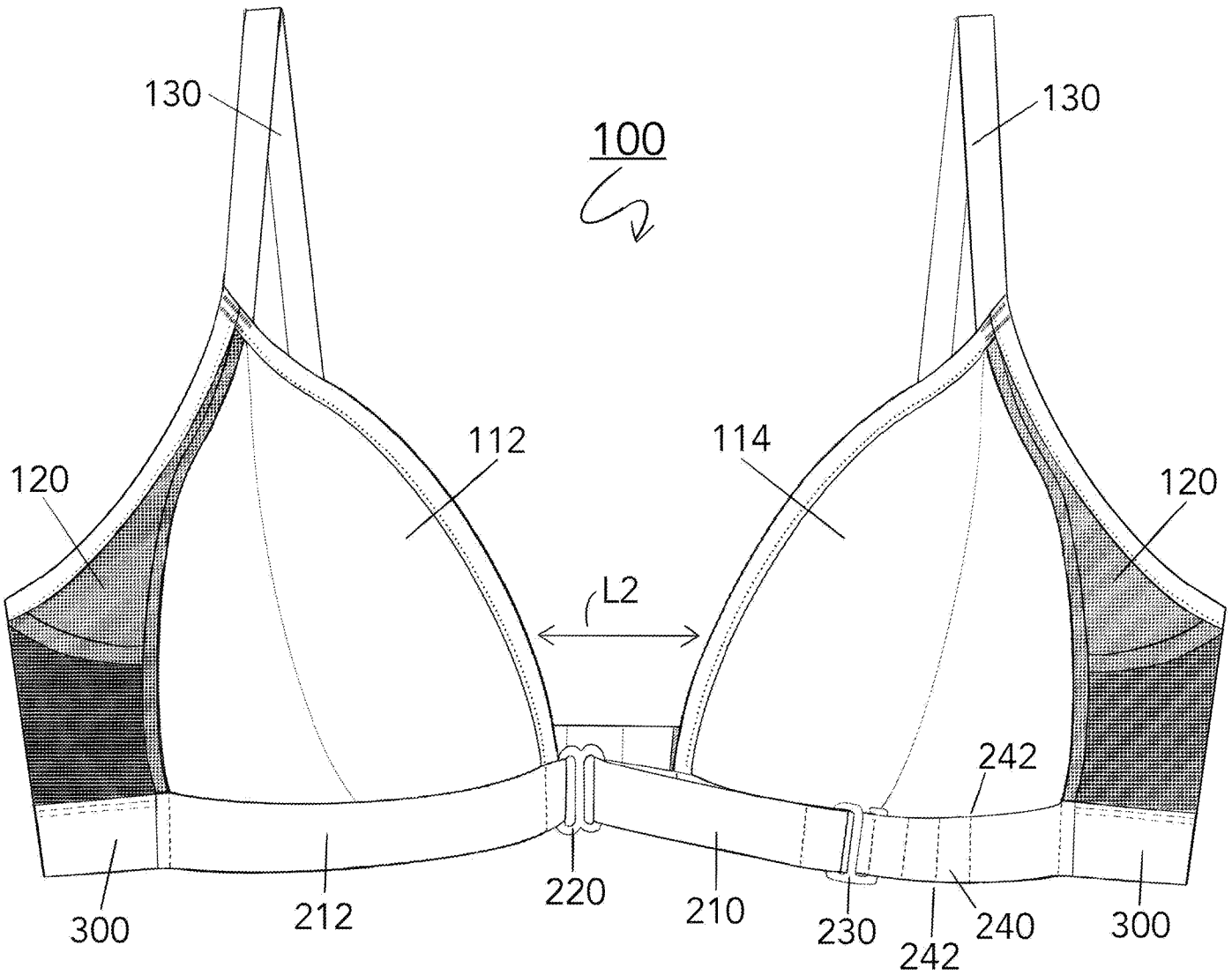
FIG. 6 is the front view of the garment in which certain aspects of the present disclosure may be implemented.

Referring to FIGS. 4, 5 and 6, in various configurations of operation, the wearer can loosen or tighten the ribbon 210 laterally by connecting the movable connector 230 to one of the cartridges 240 to accommodate a wearer's breasts. As used herein, the "valley" is the free space between the cups 112, 114, measured at the point where they are closest to each other when in a given secured position. To reduce the distance L to L1 of the valley as shown in FIG. 5, the connector 230 may be adaptively placed in one of the distally disposed cartridges 240 located towards the left side of the wearer (e.g., towards the left arm). This operation tightens the front of the bra 100 by enabling a wearer to cinch the ribbon 210. Furthermore, this operation may useful for a wearer with close-set breasts. For loosening center of the bra 100 as shown in FIG. 6, the connector 230 may be adaptively placed into one of the proximal positioned cartridges 240 near the valley to extend the distance L to L2 of the valley between the cups 112, 114. This operation may be useful for a wearer with wide-set breasts. In the example shown, L2 is greater than L1 by incremental distances as determined by the placement of the connector 230 in cartridges 240.

Turning to FIGS. 3 and 4, the adjustable bridge system 200 may have a fixed ribbon 212 attached beneath the right-side brassiere cup 112 in which a slide 220 is fixedly attached to its proximal end facing the valley of the bra 100. A ribbon construction with multiple vertical seams 242 forming open slots or channels 240 is attached below the left-side brassiere cup 114. The wearer may fasten a movable G-hook 230 within an adaptively chosen cartridge 240 to incrementally control the center spacing L between the cups 112, 114. Once a comfortable fit or desired fit is achieved for the wearer, for example, the G-hook 230 can be slid into one of the multiple stitched channels 240 located on the base of the left cup 114 of the bra 100. Sewing thread may be used to secure the components of bra 100, including the vertical seams 242 with stitching. Sewing thread can be made from a synthetic fiber material, such as polyester. Nevertheless, the thread could be made of a natural material, such as cotton.

Figure 2:
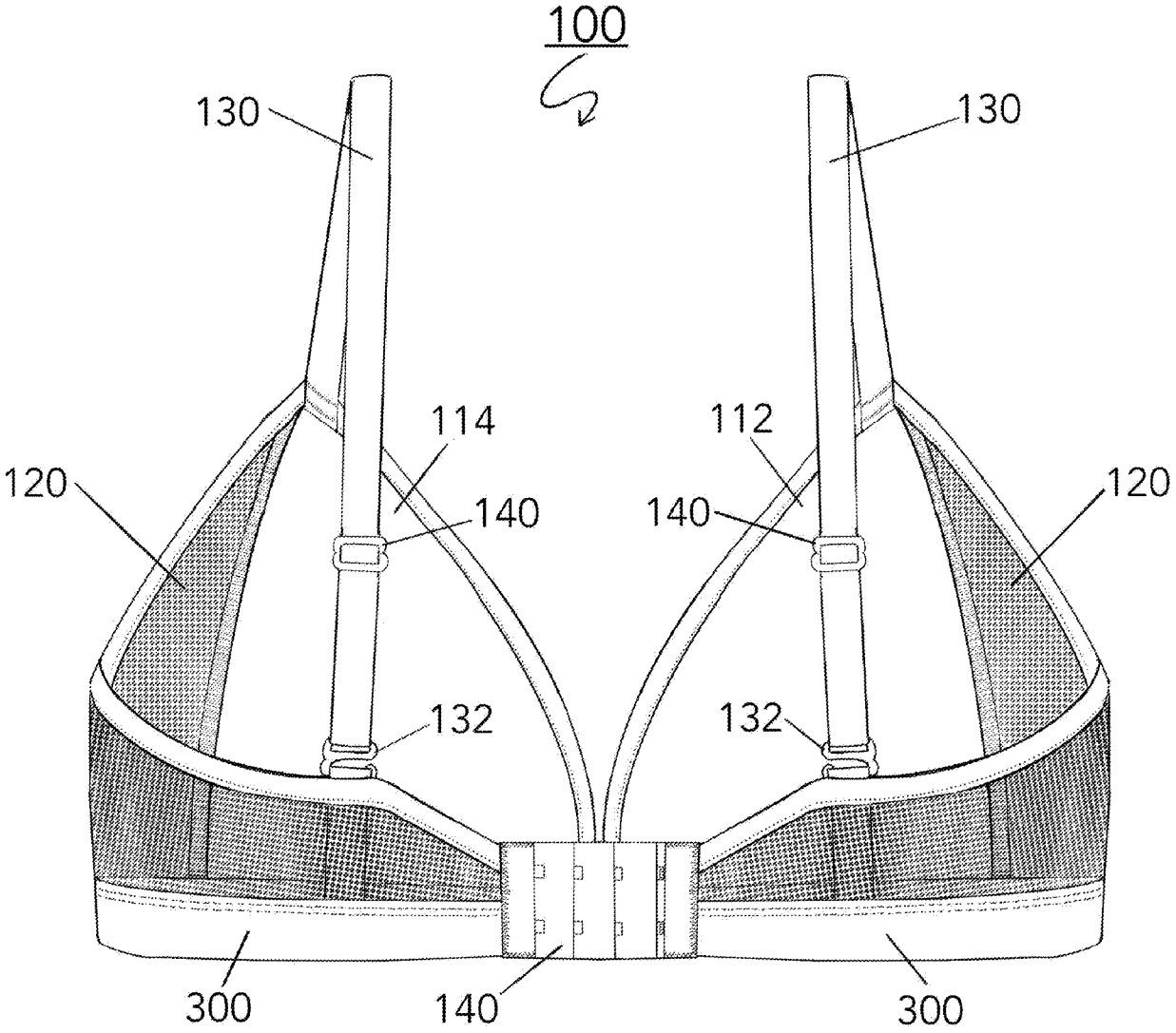
FIG. 2 is a back closed view of the upper torso garment of FIG. 1 with a rear hook-and-eye closure system fastened on the outermost row of hooks in which certain aspects of the present disclosure may be implemented.

Referring to FIGS. 1 and 2, the shoulder straps 130 are mounted towards the center of the bra 100 posterior to help reduce shoulder slippage on the wearer. Each shoulder strap 130 may have adjustable slides 140 for altering the shoulder strap length for a desired fit of the bra 100. The bra 100 may also include two adjustable elastic shoulder straps 130 with a connectable G-hook 132 to enable the wearer to achieve a "racerback" style for wearer. To achieve this style, the G-hooks are disconnected at the ends and swapped sides to form a crossing "X" shape. The straps 130 may be constructed of a woven knit elastic composed of polyester fibers or woven natural fibers, such as cotton or a blend of synthetic and natural fibers. Nevertheless, the strap 130 may constructed in a non-woven material such as an elastic material, polyurethane, polypropylene and the like.

In one construction of bra 100, a first and a second side panel 120 and underband 300 attaches to an outermost edge of the cups 112, 114. In one construction, the side panel 120 "wings" of the bra 100 are connected to a ¾ inch wide elastic underband 300 made to sit along the base of the bra 100 configured for comfort and, towards the rear of the bra 100. In one construction, the rear of the bra 100 may include a 3×2 or 4×2 padded "hook and eye" apparatus 140 for fine-tuning the underband 300 tightness around the chest circumference of the wearer. The elastic underband 300 is located along the base of the left triangular-shaped cup 112 and right triangular-shaped cup 114 of the bra 100. On the right cup 112 of the bra 100, the elastic underband 300 extends along the perimeter of the base of the bra cup 112 underneath ribbon 212. On the base of the left cup 114 the elastic underband 300 extends along the perimeter of the base and underneath the stitched channels 240. The elastic underband 300 provides for an enhanced fit around the upper torso of the wearer.

In one construction, the bra 100 may optionally include mesh side panels 120 for supporting the outermost sides of the breasts. The cups 112, 114 in the front of the bra 100 may be attached to panel wings 120 to support the outermost sides of the wearer's breast. Nevertheless, the side panel 120 can made of other woven fabric constructions, such as polyester fibers or natural fibers, such as cotton or a blend of synthetic and natural fibers.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. An upper torso garment adapted to be worn around a torso of a human wearer body, comprising:

a first brassiere cup and a second brassiere cup being configured for wear; a first side panel and a second side panel attached to an outermost edge of said cups, respectively; the first side panel and the second side panel being adapted to support peripheral sides of a breast and underneath armpits of a human wearer body; and an adjustable bridge system including a first connector facing a movable valley being defined between the first brassiere cup and the second brassiere cup; the adjustable bridge system including a second connector attached to a free end of a ribbon, the ribbon having a first ribbon portion being slidably threaded through the first connector; and the ribbon including a second ribbon portion having multiple spaced seams forming cartridges along a predetermined length below the second brassiere cup; the second connector being configured to be adaptively placed in one of the cartridges for moving the first ribbon portion to control a lateral distance of the valley.

2. The upper torso garment according to claim 1, further comprising a hook-and-eye closure attached to either end of the first and the second side panel.

3. The upper torso garment according to claim 1, further comprising a plurality of parallel shoulder straps, wherein the straps are attached to both the first and second brassiere cups at a posterior edge.

4. The upper torso garment of claim 1, wherein each the first brassiere cup and the second brassiere cup include a molded foam material therein.

5. The upper torso garment of claim 1, wherein the first side panel and the second side panel each include an open mesh material.

6. The upper torso garment of claim 1, further comprising an elastic underband at least underneath the second ribbon portion.

7. The upper torso garment of claim 1, wherein the cartridges have different lateral widths.

8. The upper torso garment according to claim 1, further comprising a plurality shoulder straps, wherein the straps are attached to both the first and second brassiere cups at a posterior edge and are convertible to form a razorback style configuration for wearer.

* * * * *